US005100361A

United States Patent [19]

Kuhn et al.

[11] Patent Number: 5,100,361

[45] Date of Patent: Mar. 31, 1992

[54] TETHERED AERIAL TOP

[75] Inventors: Thomas R. Kuhn, 546 48th Ave., San Francisco, Calif. 94121; Donald W. Watson, Rohnert Park, Calif.

[73] Assignee: Thomas R. Kuhn, San Francisco, Calif.

[21] Appl. No.: 722,965

[22] Filed: Jun. 28, 1991

[51] Int. Cl.[5] ..... A63H 1/30; A63H 1/32

[52] U.S. Cl. ..... 446/250; 446/253

[58] Field of Search ..... 446/248, 250, 251, 252, 446/253, 255, 236, 463

[56] References Cited

U.S. PATENT DOCUMENTS

| | | | |
|---|---|---|---|
| 2,891,351 | 6/1959 | Madafas et al. | 446/250 |
| 3,175,326 | 3/1965 | Isaacson | 446/250 |
| 3,805,443 | 4/1974 | Duncan, Jr. | 446/250 |
| 3,953,936 | 5/1976 | Ennis | 446/250 |
| 4,130,962 | 12/1978 | Ennis | 446/250 |
| 4,207,701 | 6/1980 | Kuhn | 446/250 |
| 4,332,102 | 1/1982 | Caffrey | 446/250 |
| 4,442,625 | 4/1984 | MacCarthy | 446/250 |
| 4,895,547 | 1/1990 | Amaral | 446/250 |

FOREIGN PATENT DOCUMENTS

| | | | |
|---|---|---|---|
| 395026 | 2/1909 | France | 446/255 |

OTHER PUBLICATIONS

Wolfgang Büzger, "The Yo-Yo: A Toy Flywheel", American Scientist, vol. 72, Mar.-Apr. 1984, pp. 137-142.

*Primary Examiner*—David N. Muir

[57] ABSTRACT

Yo-Yo embodiments with extended spin time and reliable initiation for rewinding of the tether are disclosed. An axle bearing of low friction or "frictionless" type is used for extended spin time. Player control of tether tension causes elastic deformation of tether diameter, especially in a tether strand wrapped around the axle bearing. Tension constricts the cross-sectional diameter of the strand, holding it free of the Yo-Yo sides; loss of tension expands the strand, engaging it laterally in clutch-like surface contact with the Yo-Yo sides. Tension in the tether and its wrapped strand under conditions of common Yo-Yo weight and ordinary play produce small variations in strand diameter. Player control of strand engagement with and disengagement form the Yo-Yo sides is assured by infinitely fine adjustment of the gap between the sides and by secure seizing of the Yo-Yo parts to fix the desired gap. Long periods of reliable Yo-Yo performance and extended capability to players of ordinary skill are among the attained objectives and advantages of the invention.

10 Claims, 4 Drawing Sheets

TETHERED AERIAL TOP

BACKGROUND—FIELD OF THE INVENTION

This invention relates to tethered aerial tops, known popularly as "Yo-Yos"; specifically to improved Yo-Yo axle structures.

BACKGROUND—CROSS REFERENCE TO RELATED APPLICATION

Thomas R. Kuhn filed Application Ser. No. 968,283 dated Dec. 11, 1978; U.S. Pat. No. 4,207,701 to Kuhn (1980) titled "Dismantlable Tethered Top with Reversible Halves", relating to improved axle structures in Yo-Yos, was subsequently issued.

BACKGROUND—DISCUSION OF PRIOR ART

Early Yo-Yos were assembled with one end of the string captured between the axle and one side of the Yo-Yo; some modern Yo-Yos, for the use of novice or unskilled players, are so assembled. Such Yo-Yos cannot spin or "sleep" at the end of the string. Since the mid-1920s, popular Yo-Yos have been tethered by using a detachable string looped over one side of the Yo-Yo with the loop then resting loosely around the axle and leading from the axle to an appropriate attachment to the player's hand. By this method of string placement, the Yo-Yo is left free to spin or "sleep" for a time in the loop at the axle in the performance of certain tricks. A Yo-Yo "sleeping" must be "waked"; that is, caused to engage the string at the axle, initiating rewinding of the string in the space between the sides and, with sufficient spinning momentum, return the Yo-Yo to the payer's hand. In "The Yo-Yo: A Toy Flywheel", AMERICAN SCIENTIST, Volume 72, March–April 1984, pages 137–142, Wolfgang Burger explains that the sleeping Yo-Yo is "waked" by a sudden pull on the string. Consequent interactions between the string and the rotating parts of the Yo-Yo cause the string to be wrapped tightly around the axle, and in the space between the Yo-Yo sides, returning the Yo-Yo to the player's hand. Burger mentions "capstan friction", which occurs between the portion of string looped around the axle and the peripheral surface of the rotating axle, as an initiating cause for the rewinding of the string. The capstan friction between the string and axle, necessary to successful "waking" of the Yo-Yo, acts also to limit playability. Most importantly, the capstan friction acts to slow the spinning of the Yo-Yo, resulting in undesirable early termination of play in "sleeping" tricks; capstan friction also acts to fray the string at the axle resulting in short playing life of the string and possible damage to the Yo-Yo if the string breaks during play.

Attempts have been made to reduce and to eliminate the aforementioned capstan friction in order to extend significantly the spin time in a single throw of the Yo-Yo. U.S. Pat. No. 4,130,962 to Ennis (1978) describes a smooth axle of reduced diameter providing "lower friction", meaning in fact lower retarding torque. U.S. Pat. No. 4,895,547 to Amaral (1990) describes the elimination of capstan friction between the string and axle, placing a low-friction sleeve bearing on the central axle and looping the string around the sleeve. U.S. Pat. No. 3,175,326 to Isaacson (1965) eliminates capstan friction using a ball bearing on the central axle with a specialized ring mounted at the periphery of the bearing and with the string looped around the ring. Each of the three patents cited above describe Yo-Yo embodiments where no provision is made to adjust the width of the gap between the Yo-Yo sides.

In each of the cases cited above, the deliberate reduction or elimination of capstan friction is recognized as resulting in the need for some other interaction between the string at the axle and the rotating parts of the Yo-Yo to initiate rewinding of the string. On the inner faces of the Yo-Yo sides in the radial proximity of the axle, Ennis provides laterally projecting "protuberances" for "engaging the string", and Amaral provides "radially extending raised ribs" to "enhance the ability of the Yo-Yo to engage the string". Isaacson describes the use of conical surfaces between the ring attached to the ball bearing and the spinning Yo-Yo sides to capture the string.

The "protuberances" and the "raised ribs" described in the respective Ennis and Amaral cases cited above present the player with a Yo-Yo having certain disadvantages and limitations, among which are:

1. Lack of positive, continuous, and pressureful contact with the string when it is desired to initiate rewinding of the string, causing unpredictable failure of the Yo-Yo to return to the player's hand when desired; if and when the desired return does occur, the first few rewound turns of the string are often loosely wound causing unpredictable performance on the next throw of the Yo-Yo. Where a sleeve bearing or ball bearing is used, at least one of the suppliers currently uses a viscous grease lubricant thus introducing viscous friction induced torque to initiate reliable rewinding of the string; it must be said that this induced torque obviously and disadvantageously acts to defeat the original objective of free spinning of the Yo-Yo in normal play and brings into question the reliability of, or need for, "protuberances" or "raised ribs".

2. Interference with performance of well known "string" tricks wherein more than one lay of string is placed at or near the axle of the "sleeping" Yo-Yo; in these circumstances the laterally projecting tips contact the string, at best producing undesirable noise and vibration while retarding the spin of the Yo-Yo, and at worst gripping the string to abruptly terminate performance.

3. Fraying of the string by intended or unintended contact with the laterally projecting tips, resulting in reduced life of the string; the earlier cited Ennis case describes "cone shaped protuberances with *rounded* ends", apparently to reduce the recognized fraying of the string.

In the Isaacson case cited above, the ring attached at the periphery of the ball bearing significantly increases the diameter around which the string must be looped. It is well known in the Yo-Yo art that the diameter of the axle around which the string is looped must be kept small, else the Yo-Yo on being thrown from the hand will reach the end of the string with an undesirable shock. The structure described by Isaacson then results in increased shock to the string, interfering with successful performance and enjoyment in Yo-Yo play while subjecting the string to breakage from undesirably high tension stress.

Each of the three cases cited above describes Yo-Yo embodiments wherein some provision is made in attempts to cause the rotating parts of a Yo-Yo to engage the string, and thus to initiate rewinding of the string. In each case, certain disadvantages have been here defined. A primary objective of the present invention is to provide Yo-Yo embodiments wherein heretofore unrecognized but remarkable elastic properties of common Yo-Yo string will be employed to avoid each and all of the earlier defined disadvantages. Exploitation of the elastic properties of common Yo-Yo string will be shown to provide the Yo-Yo with greatly improved reliability and potential for play by users of ordinary skill.

In the earlier cited cases for Ennis, Amaral, and Isaacson the absence of provision to adjust the width of the gap between the Yo-Yo sides presents the buyer with immediate disadvantage. In current marketing practice, Yo-Yos are most commonly sealed in a package when delivered to the buyer. In consequence, the buyer already owns the Yo-Yo on opening the package. If the Yo-Yo is a poor performer because of too narrow or too wide a gap between the sides, the buyer may be constrained to put up with the problem or buy another, searching for a better performing Yo-Yo. Further disadvantage is presented to the player since the Yo-Yo gap width cannot be adjusted to accommodate to the particular diameter of the string to be used, to the personal style and technique or other preference of the player, or to the types of tricks to be performed. Indeed, it is well known that commonly available Yo-Yos provide a narrow gap that prevents the reliable or successful performance of some tricks. Even if the Yo-Yo is dismantlable as few are, it is not intended that the gap be adjusted; if the Yo-Yo is not dismantlable the fault can only be corrected with great effort and skill by the buyer. U.S. Pat. No. 2,891,354 to Madaras and Madaras (1959) describes a structure holding the Yo-Yo sides "in adjustably connected spaced relation" for a purpose not pertinent to the present invention. The "spaced relation" is apparently achieved with the use of spacers or washers, though such parts are not mentioned; it is nowhere shown how infinitely fine adjustment of the gap width can be accomplished with cooperating secure fixing of the desired gap. Heretofore, the need for Yo-Yo axle designs which permit infinitely fine adjustment of the gap between the sides, with attendant secure fixing of the desired gap, has not been appreciated. Another primary objective of the present invention is to define Yo-Yo embodiments wherein that adjustment *and* cooperating secure fixing of desired gap width are provided. The present invention will also show that this control of gap width provides a Yo-Yo with even further improved reliability and playability to the user of ordinary skill.

OBJECTS AND ADVANTAGES

Accordingly, this invention teaches new and heretofore unseen Yo-Yo axle design embodiments wherein several important objects and advantages are achieved, among which are:

1. Elimination of capstan friction between the strand portion of the string wrapped around the axle and peripheral surface of the axle, thus providing desirable extended interval of controllable play in tricks where "sleeping" action of the Yo-Yo is required.

2. Infinitely fine adjustment of the gap width in the immediate proximity of the axle surface about which a strand portion of the Yo-Yo string or tether is looped, with attendant firm and secure seizure of the Yo-Yo parts to maintain that desired gap width, thus;

(a) allowing the string, when under the tension of normal play where the diameter of the string and its strand are significantly reduced elastically, and where "sleeping" action of the Yo-Yo is required, to avoid pressureful lateral contact with immediately adjacent rotating surfaces of the Yo-Yo sides.

(b) allowing the string, when under player control the string tension is substantially reduced or removed, to attempt elastically to restore itself and its strand to their original respective diameters; thus to produce positive and continuous pressureful and clutch-like contact with adjacent rotating surfaces of the Yo-Yo sides, thereby reliably initiating rewinding of the string.

(c) allowing the player to readjust and to again securely fix the gap width to accommodate it to the reduction of string diameter over its life in play as its fibers become compacted, or to the particular diameter of each fresh string when it is attached to the Yo-Yo.

(d) allowing the player to adjust and then to fix the width of the space between the Yo-Yo sides for best performance according to personal style and technique or other preference, and optionally according to the type of trick to be performed; namely, sleeping, nonsleeping, looping, tricks of extended duration, and others.

(e) allowing the player the potential to perform Yo-Yo tricks impossible, or at least significantly more difficult, to perform with a Yo-Yo lacking any of the axle improvements of the present invention; and greater ease of performance in general, given extended interval of play in a single throw of the Yo-Yo.

(f) allowing the player to dismantle, easily and conveniently, at least one of the Yo-Yo sides to remove tangled string from the space between the sides and to inspect, clean, or replace parts as might be required occasionally, and then to reassemble the Yo-Yo to the desired playing condition.

3. Elimination of the need for laterally projecting "protuberances", "raised ribs" or similar surface modifications in the radial proximity of the axle thereby enabling or improving the performance of certain Yo-Yo tricks where such modifications impede Yo-Yo spinning or cause abrupt termination of attempts to perform the tricks; these are tricks where string manipulations by the player bring more than one lay of string in close proximity to the Yo-Yo axle.

4. Greatly extended life of the Yo-Yo string, by elimination of relative motion between the string at its strand portion looped about the axle and the periphery of the axle, and by presentation of deliberately smooth or even polished surfaces everywhere else that the string might contact the rotating parts of the Yo-Yo.

5. Further extension of string life by use of an axle bearing of least practical diameter, with the string looped directly on the bearing periphery; thus avoiding unnecessary tension shock to the string when the Yo-Yo reaches the end of the string in ordinary play.

6. Reduced rate of angular velocity deceleration of the rotating parts, thus providing significantly reduced rate of precession and enhanced playability, especially in the early period of the aforementioned extended play interval.

7. Significantly more positive and more reliable initiation of rewinding of the string under the player's control than is provided with Yo-Yos having roughly equivalent duration of play but which lack certain of the axle improvements of the present invention.

8. Reliable initiation of rewinding of the string under the player's control assuring tight rewinding of the early turns; and providing enhanced Yo-Yo performance in windy environments, where heretofore it has been well known that ambient wind action acts to defeat the initiation of rewinding of the string in Yo-Yo embodiments of earlier description.

9. Axle structures manufacturable in combinations of various commonly available metals and other suitable materials, but wherein certain of the elements can be integral with the Yo-Yo sides; and axle structures useful in Yo-Yo sides manufacturable of an even wider variety of materials including, but not limited to, metals, plastics, and woods, or combinations of such materials.

10. Axle structures allowing certain YoYo embodiments wherein the YoYo sides are manufactured of wood or other suitable materials, and where the external aspect of those embodiments provides the look and feel of the traditional wood and plastic Yo-Yo shapes; namely in the overall shape of a doughnut without the central hole, and the commonly known "butterfly" style.

11. Axle structures especially for, but not limited to, use in wood or plastic Yo-Yo sides leaving the outer surfaces undisturbed and available for the optional imprinting of designs or various indicia.

In the realization of the objects and advantages of the present invention, the need for and the use of torque inducing viscous grease lubricants in the axle bearing is specifically avoided.

Further objects and advantages will become apparent from consideration of further parts of this specification.

REFERENCE NUMERALS IN DRAWINGS

| | | | |
|---|---|---|---|
| 10 | String | 50 | Plug |
| 12 | Strand | 52 | Bore |
| 12' | Strand, phantom outline | 54 | Groove |
| 13a | Left Leg | 56 | Knurl |
| 13b | Right Leg | 58 | Inner Face |
| 14 | Loop | 58a | Narrow Gap |
| | | 59 | Outer Face |
| 20 | Axle Screw | | |
| 22a | Left Seizing Thread | 70a | Left Side |
| 22b | Right Seizing Thread | 70b | Right Side |
| | | 72 | Rim |
| 30 | Axle Bearing | 74a | Outer Face |
| 32 | Bearing Ball | 74b | Inner Face |
| 34a | Inner Race | 76 | Wide Gap |
| 34b | Outer Race | 78 | Hole |
| | | 78a | Round Corner |
| 40 | Gap Screw | | |
| 42 | Hole | | |
| 44 | Shoulder | | |
| 44a | Adjustment Space | | |
| 46 | Slot | | |

-continued

| | |
|---|---|
| 48 | Positioning Thread |

DESCRIPTION OF INVENTION

Figure 1:
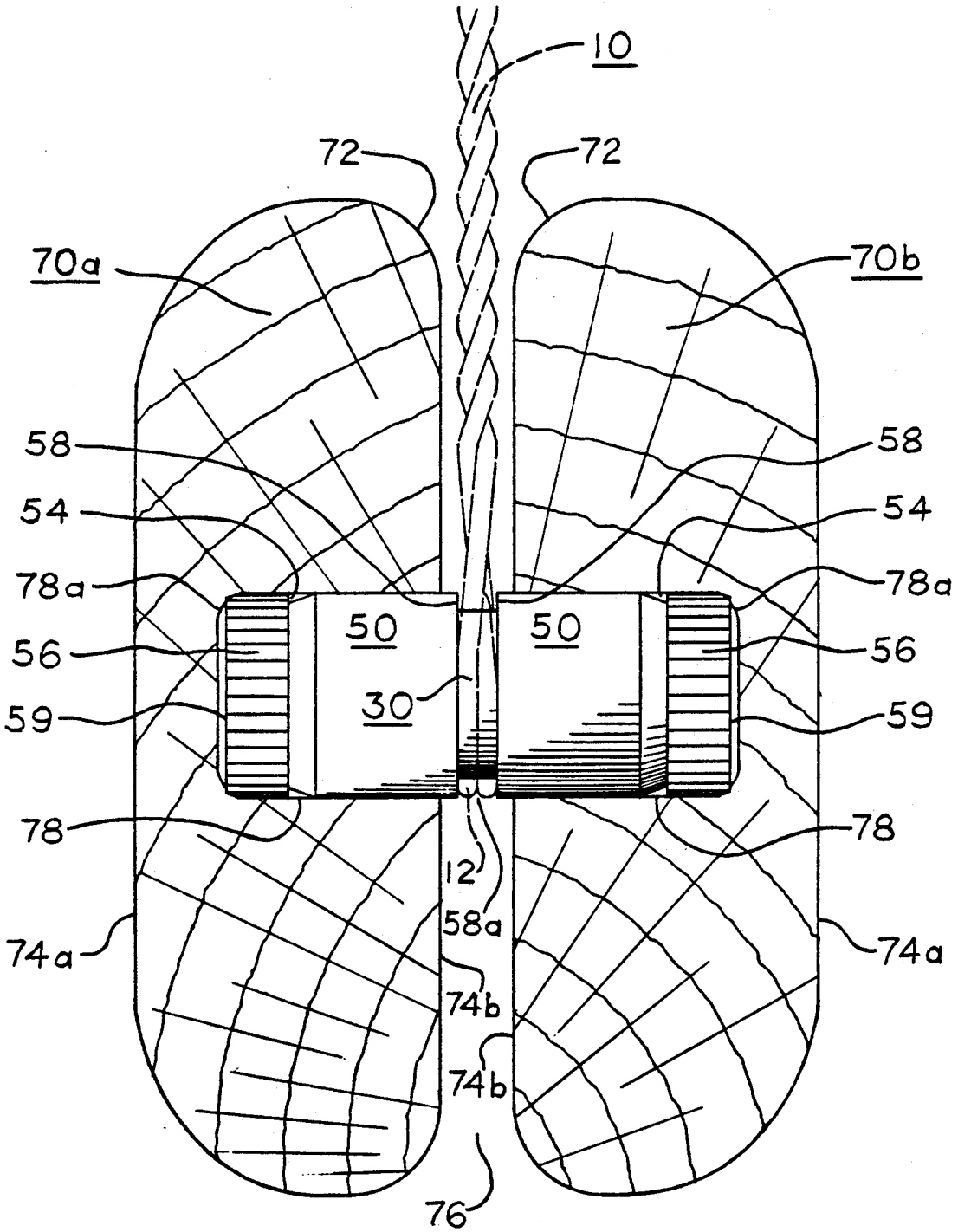
FIG. 1 shows a cross-sectional view of one preferred embodiment for a Yo-Yo of the present invention.

FIG. 1 shows one preferred embodiment of the present invention. Disc-like and identically shaped sides 70*a* and 70*b* are each approximately 57 millimeters (2.25 inches) in diameter and approximately 13 millimeters (0.5 inches) wide, and both are formed of a common readily available material such as hard wood or other material of similar strength and density. Sides 70*a* and 70*b* provide inertia while rotating when the Yo-Yo is in play. At and parallel to the axial center of each of sides 70*a* and 70*b*, a cylindrically bored hole 78 is provided beginning at an inner face 74*b* but not extending through to an outer face 74*a*. Each cylindrical hole 78 is shaped with a round corner 78*a* at its full depth. A cylindrical plug 50, preferably but not exclusively fabricated of a light weight metal such as aluminum, is tightly and permanently seated in hole 78 of side 70*a*, and another plug 50 is similarly seated in hole 78 of side 70*b*. Each of the plugs 50 is so seated leaving its inner face 58 projecting beyond its associated inner face 74*b*. Each plug 50 is fabricated with a knurled cylindrical surface 56 which intimately engages the cylindrical wall of hole 78 and a lateral portion of round corner 78*a*, and is further fabricated with a peripheral groove 54. The aforementioned tight seating and fabricated of each plug 50 prevent shifting of its position in its associated side 70*a* or 70*b* under forces the Yo-Yo encounters in normal use. The position of each plug 50 is further secured laterally in cylindrical hole 78 by its abutment with round corner 78*a* and, in the opposite lateral direction, by engagement of the peripheral edge of one vertical side of groove 54 with the cylindrical wall of hole 78. Each plug 50 is even further secured in either lateral direction and especially in either rotational direction by intimate engagement of knurled surface 56 with the cylindrical wall of hole 78. String 10 and its strand portion 12 are shown in phantom outline for clarity, with strand 12 wrapped twice around the periphery of a partially shown axle bearing 30 and located in gap 58*a* between annular and smoothly surfaced inner faces 58 of the plugs 50. String 10 extends from its strand 12 in narrow gap 58*a* into a wider gap 76 formed between annular and smoothly surfaced inner faces 74*b* of sides 70*a* and 70*b*, then beyond a rim 72 of each of the cited sides to the Yo-Yo player's hand. String 10 with its strand portion 12 at axle bearing 30 and its attachment to the player's hand form an elastic tether of the present invention.

Figure 1A:
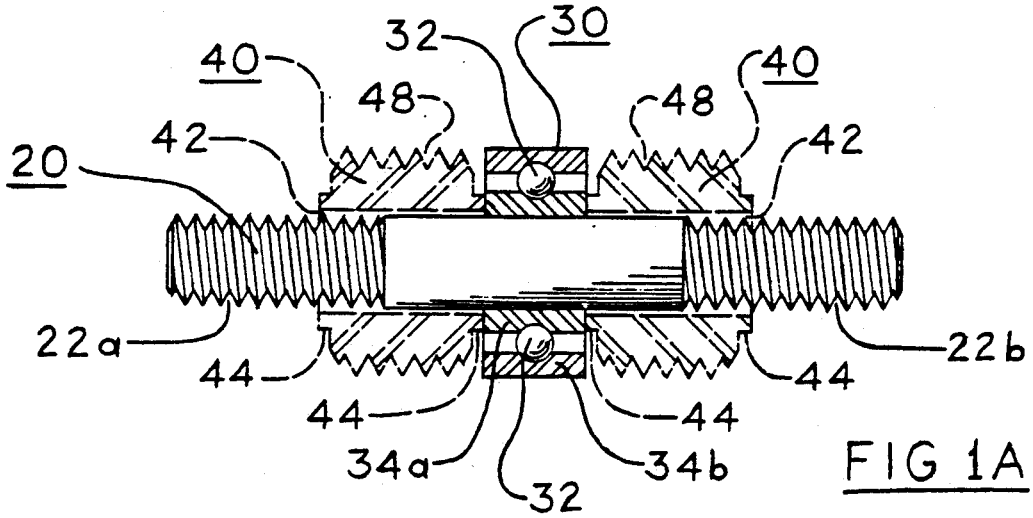
FIG. 1A shows the innermost view for parts of the Yo-Yo of FIG. 1.

FIG. 1A shows an axle screw 20, a slender cylindrical shaft typically though not exclusively fabricated of steel with a left seizing thread 22*a* and a right seizing thread 22*b*, and with a central portion left unthreaded. Axle bearing 30 is centrally mounted on axle screw 20; an inner race 34*a* is an annular ring which fits closely to, but slides easily on, axle screw 20. A plurality of bearing balls 32 captured between inner race 34*a* and an outer race 34*b* allow the cited races to move freely in rotation relative to each other around their common cylindrical axis while being restrained to a common lateral position. In phantom outline and in cross-section for clarity, a pair of cylindrical gap screws 40 are shown each with a peripheral positioning thread 48, a shoulder 44 at each end, and a clearance hole 42 for axle screw 20; gap screws 40 are each shown with one shoulder 44 abutting only inner race 34*a* of axle bearing 30.

Figure 1B:
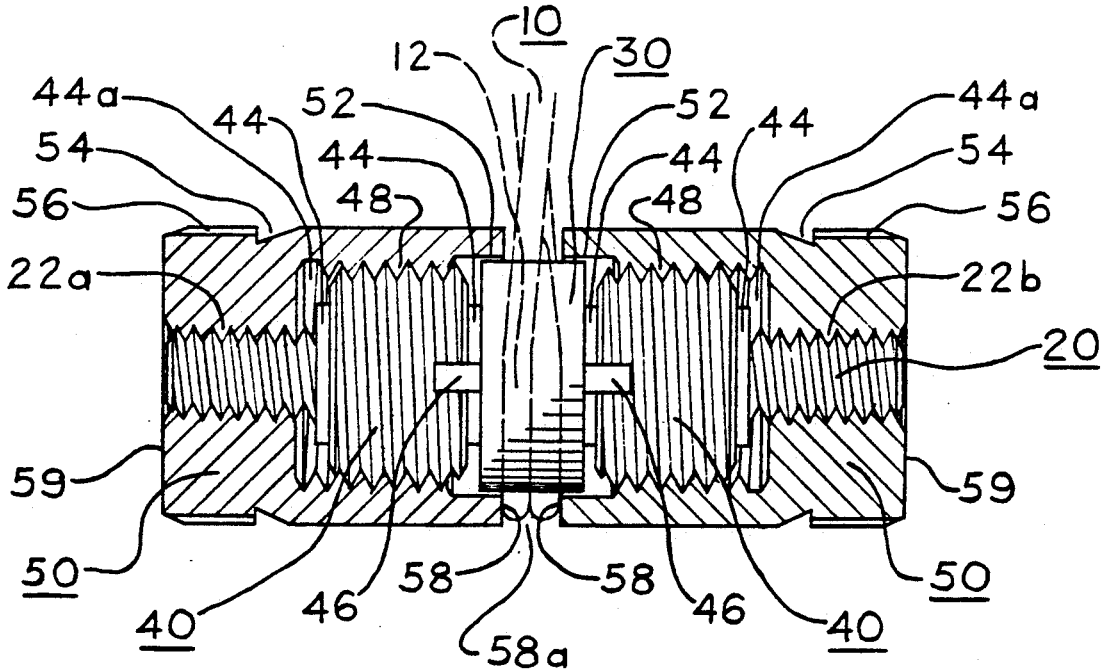
FIG. 1B shows the next innermost view for parts of the Yo-Yo of FIG. 1.

FIG. 1B shows gap screws 40 each located with positioning thread 48 in a similarly but internally threaded interior of its associated plug 50. Location of each gap screw 40 places the opening of a slot 46 and one shoulder 44 abutting axle bearing 30 and leaves an adjustment space 44*a* between opposite shoulder 44 and a laterally adjacent interior surface of plug 50. Left seizing thread 22*a* and right seizing thread 22*b* of axle screw 20 each engage a similarly but internally threaded portion of an associated plug 50; engagement of the cited threads is such that each lateral extremity of axle screw 20 is approximately coplanar with an outer face 59 of an associated plug 50. Plugs 50, in consequence of their positions on axle screw 20, substantially overlap axle bearing 30 in their respective bores 52, and a narrow gap 58*a* is left between their respective inner faces 58. Cylindrical bores 52 of plugs 50 are of diameter slightly greater than that of axle bearing 30, and of sufficient depth that outer race 34*b* contacts only bearing balls 32 and is contacted in turn only by strand 12 of string 10.

Figure 2A:
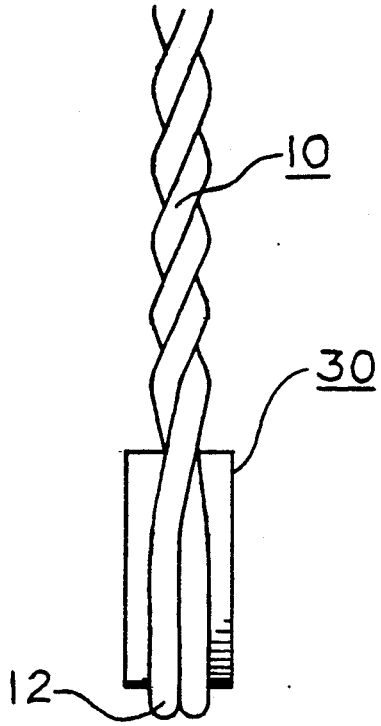
FIG. 2A shows a string 10 and axle bearing 30 extracted from FIG. 1.

FIG. 2A shows string 10 with strand 12 centrally wrapped twice around the periphery of axle bearing 30; the view is from the front with the components shown as if removed for clarity from the Yo-Yo of FIG. 1.

Figure 2B:
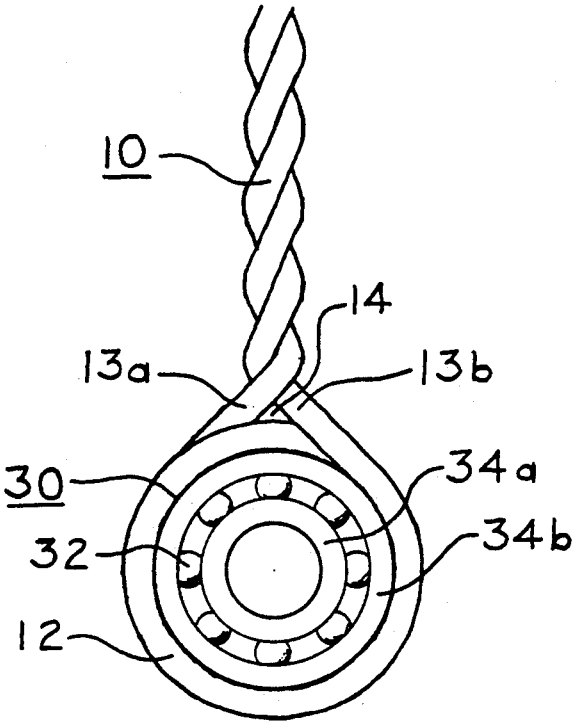
FIG. 2B shows a side view of FIG. 2A for further detail and clarity.

FIG. 2B shows the components of FIG. 2A, but in a side view wherein further detail is made clear. Strand portion 12 is shown wrapped twice around outer race 34*b* of axle bearing 30. A left leg 13*a* and a right leg 13*b* of strand 12 are shown forming a teardrop-shaped loop 14 which leads upward to string 10. Bearing balls 32 are shown circumferentially spaced between inner race 34*a* and outer race 34*b*.

Figure 3A:
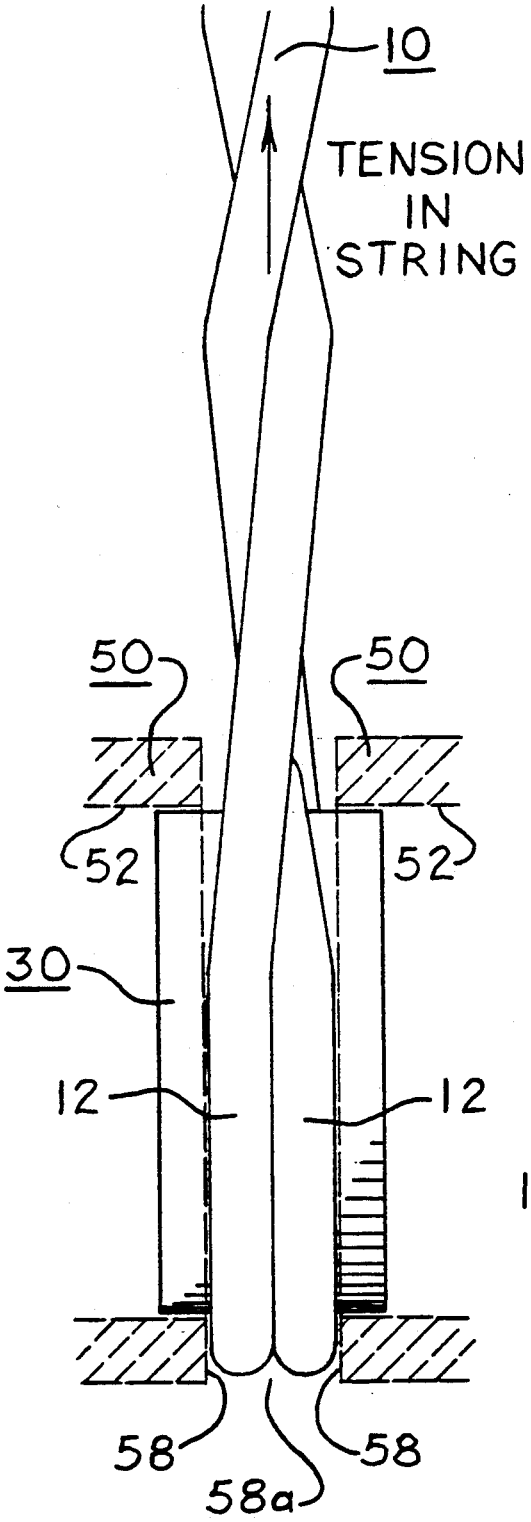
FIG. 3A shows the assemblage of FIG. 2A enlarged, with string 10 under tension.

FIG. 3A is an enlarged version of FIG. 2A, with the most central portions of plugs 50 shown in phantom outline and cross-section for clarity. Inner face 58 of each of the plugs 50 form gap 58*a* within the lateral limits of which strand 12 is shown wrapped twice around the periphery of axle bearing 30. Strand 12 leads at each end to string 10 which is shown to be under tension. Cylindrical bore 52 in each plug 50 is shown to be larger in diameter than axle bearing 30.

Figure 3B:
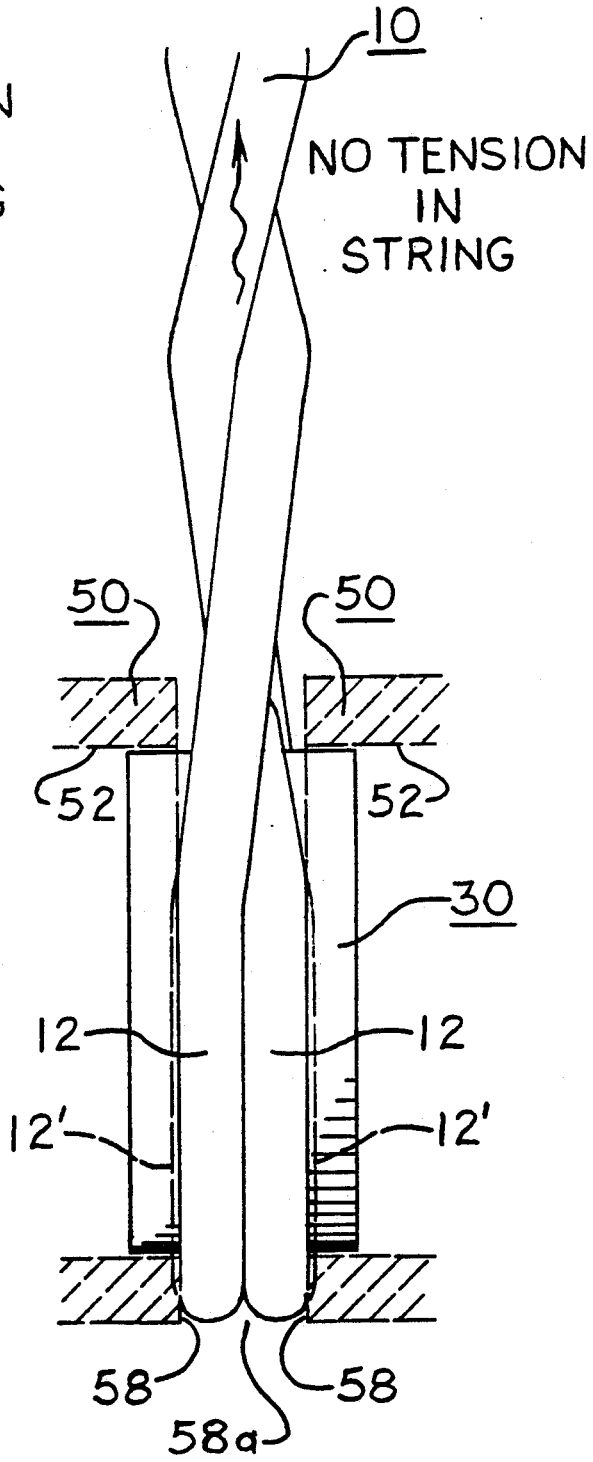
FIG. 3B repeats FIG. 3A showing string 10 under no tension.

FIG. 3B, shows the same view and components as FIG. 3A. String 10 is shown to be under no tension. Strand 12 is shown expanded, to its relaxed diameter in the absence of tension transmitted to it from string 10, but restrained between inner faces 58 of plugs 50. A phantom outline of strand 12' is shown, representing the position strand 12 would occupy were it not laterally constrained by inner faces 58 of plugs 50.

Figure 4A:
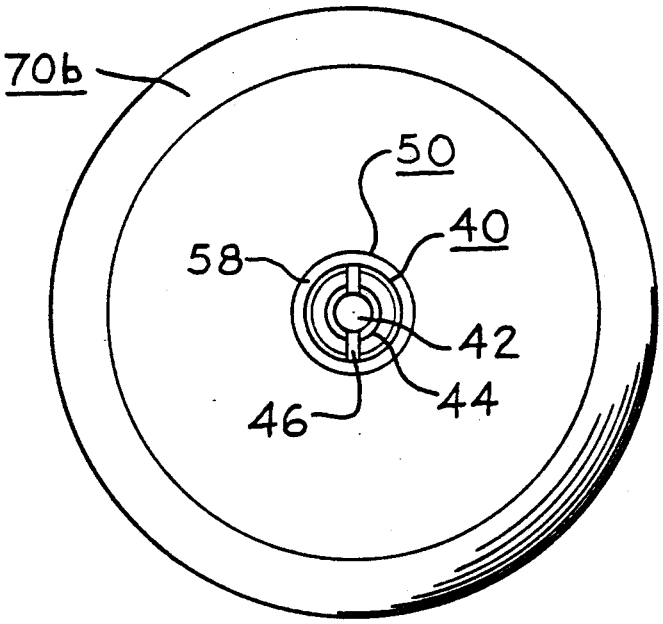
FIG. 4A shows a facing view of one side of the Yo-Yo removed from FIG. 1.
Figure 4B:
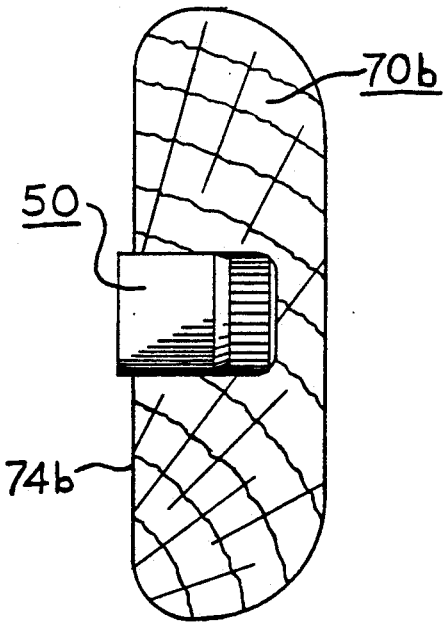
FIG. 4B shows a side view of FIG. 4A for clarity.

FIG. 4A and FIG. 4B display in a full inner face view and in a cross section side view, respectively, the central disposition of plug 50 in side 70*b* with side 70*b* dismounted from the Yo-Yo of FIG. 1. FIG. 4A particularly shows slot 46 exposed for access to allow adjustment of gap screw 40 with a finger nail or simple tool.

OPERATION OF THE INVENTION

The following text and cited drawings together completely describe the operation of a preferred embodiment of the present invention. Particular attention is given to the elastic action of the tether in normal play with the Yo-Yo of FIG. 1. Attention is also given to the means whereby major parts of the Yo-Yo cooperate in use to allow infinitely fine adjustment for the width of the space between the Yo-Yo sides, and then cooperate in use to be seized together thus securely fixing the desired space between the cited sides.

FIG. 1 shows string 10 in phantom outline for clarity; string 10 is typically but not exclusively manufactured of cotton fiber twisted to thread, threads counter-twisted to ply, and plys counter-twisted to strand 12. Finally, strand 12 is folded back on itself and twisted to form the body of string 10. At the folded end, string 10 is untwisted a short distance to open a loop portion of strand 12; the open loop is slipped over either side 70*a* or 70*b* and wrapped twice around axle bearing 30. The opposite end of string 10 is appropriately knotted and attached to a finger of the player's hand in a commonly known manner. String 10 and its strand 12 are resilient and highly elastic; they are in fact slender compound helical springs. String 10, including the strand 12 portion looped around axle bearing 30, a suitable length for advantageous play, and a portion attached to the player's hand, together form an elastic tether in the present invention. When by any external action of the player string 10 and its strand 12 are placed under tension, they are elongated elastically and their respective diameters are elastically reduced less obviously but significantly. Conversely, if the tension is removed, string 10 and its strand 12 are elastically restored to their original respective lengths and elastically expanded to their original respective diameters. The effects of tension application to and removal from string 10 as transmitted to strand portion 12 in narrow gap 58*a* are of greatest importance in the present invention.

FIG. 2B shows left leg 13*a* and right leg 13*b* each forming an angle of approximately 45 degrees with the vertical axis of string 10. Tension when present in string 10 is distributed equally to leg 13*a* and leg 13*b*; but the laws of physical mechanics prescribe that the resultant tension in each of the cited legs, because of the angle each holds with respect to the vertical, is approximately 1.4 times one-half the tension in string 10. If string 10 supports the weight of a typical Yo-Yo, approximately 60 grams, then each length of strand 12 in the main body of vertical string 10 supports approximately 30 grams; but the resultant tension in each of the legs 13*a* and 13*b* and throughout strand 12 in its position around axle bearing 30 is approximately 42 grams. This amplification of tension in that portion of strand 12 wrapped around axle bearing 30 results in maximum available differential in the diameter of strand 12 from an applied tension condition to a removed tension condition. Laboratory measurements determine the approximate diameter of strand 12 in its position around the periphery of axle bearing 30 to be 0.89 millimeters (0.035 inches) with no tension in string 10, and 0.81 millimeters (0.032 inches) with string 10 under a tension of 60 grams supporting the weight of a typical Yo-Yo. Thus, the diameter of strand 12 expands approximately 0.08 millimeters (0.003 inches) or nearly 10 percent when tension equivalent to the weight of typical Yo-Yo is removed. This phenomenon of contraction and expansion of strand 12 under the application and removal of tension is used to great advantage in the current invention as will immediately be shown.

FIG. 3A and FIG. 3B each show the detail of FIG. 2A greatly enlarged for clarity; the phantom outline and cross-section of the innermost ends of plugs 50 are shown in their intended fixed position, substantially overlapping axle bearing 30, and forming gap 58*a* of fixed width between inner faces 58. FIG. 3A shows string 10 under tension, assumed to be 60 grams. Each wrap of strand 12 has a diameter of approximately 0.81 millimeters (0.032 inches); thus the side-by-side wraps of strand 12 together occupy a lateral width of 1.62 millimeters (0.064 inches). The width of gap 58*a* between inner faces 58 is shown adjusted to and fixed at a width equal to or slightly greater than 1.62 millimeters (0.064 inches); that width being the same in FIG. 3B as well. FIG. 3B shows string 10 under no tension, further showing a phantom outline strand 12' where strand 12 attempts to expand elastically to its relaxed diameter of 0.89 millimeters (0.035 inches), with the side-by-side wraps together attempting to occupy a total lateral width of 1.78 millimeters (0.070 inches). The side-by-side wraps of strand 12 together attempt a total lateral elastic expansion of approximately 0.16 millimeters (0.006 inches). Strand 12 succeeds in its attempted expansion everywhere except in the greater peripheral portion of gap 58*a* where it is confined between the inner faces 58 of plugs 50. This elastic expansion of strand 12 causes it to engage inner faces 58 in laterally directed clutching action with positive pressureful contact. If the tension in string 10 is reapplied, the conditions shown in and earlier described for FIG. 3A are restored; that is, the diameter of strand 12 elastically contracts to substantially remove pressureful contact with inner faces 58, terminating the aforementioned clutching action. FIG. 3A displays the condition under which the Yo-Yo of FIG. 1 can rotate with its rotating parts substantially free of friction at axle bearing 30, with only outer race 34*b* (FIG. 1A and FIG. 2*b*) held stationary with respect to strand 12. FIG. 3B displays the condition under which strand 12 is positively and continously engaged with immediately adjacent rotating surfaces of the Yo-Yo of FIG. 1 to reliably initiate rewinding of string 10 to return the Yo-Yo to the player's hand. The absolute values of the dimensions given here are less important than the relative value determined to be available for the clutching engagement and disengagement described; that is, adjustment of the width of gap 58*a* from freedom of contact of strand 12 with inner faces 58 to positive engagement of strand 12 with inner faces 58 must be made in the order of approximately 0.16 millimeters (0.006 inches). The clutching action herein described demands infinitely fine adjustment for the width of gap 58*a* and the secure fixing of that adjustment. FIG. 1 shows a fully assembled Yo-Yo of one preferred embodiment of the present invention. Each plug 50 is already permanently seated in an associated side 70*a* or 70*b*. Sides 70*a* and 70*b* when rotating provide inertia for continued rotation and to rewind string 10 in the final interval of trick performance. The cited sides with plugs 50, gap screws 40, axle bearing 30, and axle screw 20 are pulled firmly together into the positions shown in FIGS. 1 and 1B by holding side 70*a* in one hand and turning side 70*b* clockwise as viewed from that side. Plugs 50 act on the seizing threads 22*a* and 22*b* to bring gap screws 40 into firm abutment with inner race 34*a* of axle bearing 30 (FIG. 1A and FIG. 1B). Sufficient torque is then applied between the cited sides to seize the cited parts tightly enough between the cited seizing threads of axle screw 20 to assure that the assembly will not loosen during normal Yo-Yo play. Trial play with the Yo-Yo of FIG. 1 determines whether or not the width of gap 58*a* provides the desired free spinning during play and the desired reliable initiation of rewinding of string 10 to terminate play. Absence of free spinning requires slight widening of gap 58*a*. Return of the spinning Yo-Yo hanging at the end of string 10 is easily tested by a sharp vertical tug on string 10; if initiation of rewinding of the string fails, slight narrowing of gap 58*a* is required. The width of gap 58*a* can be adjusted by removing one side, 70*b* for example, from the Yo-Yo of FIG. 1. With the string fully unwound as in FIG. 1, side 70*a* is held in the left hand with the thumb grasping string 10 under tension and in firm contact with rim 72 of side 70*a*. Tension in string 10 between the left thumb and axle bearing 30 holds axle screw 20 constrained in its left seizing thread 22*a*. The right hand is then used to rotate side 70*b* counterclockwise as viewed from the right until side 70*b* is fully disengaged from right seizing thread 22*b* of axle screw 20. In the process of removing side 70*b* as just described, its associated gap screw 40 maintains its position in plug 50 since hole 42 keeps it clear of axle screw 20.

FIG. 4A shows side 70*b* dismantled from the Yo-Yo of FIG. 1 in the manner just described and viewing its inner face 74*b* directly. In full view in FIG. 4A are inner face 58 of plug 50, and hole 42, shoulder 44, and slot 46 of gap screw 40. Gap screw 40 is seated in its positioning thread 48 (FIG. 1B) of pitch thirty-two (32) threads per inch, or approximately 0.80 millimeters (0.0313 inches) per turn. Clearly, very fine adjustment for the depth of gap screw 40 in its associated plug 50 is possible. For example, taking the view of side 70*b* as the face of a clock, a 10-minute clockwise turn of gap screw 40 using a finger nail or tool in slot 46 will position gap screw 40 one-sixth of a turn or approximately 0.13 millimeters (0.005 inches) deeper in plug 50. Side 70*b* is then remounted to reform the Yo-Yo of FIG. 1 by engaging its plug 50 with right seizing thread 22*b* of axle screw 20 and tightening the sides 70*a* and 70*b* on axle screw 20 with a resulting reduction of the same 0.13 millimeters (0.005 inches) in the width of gap 58*a*. In like manner, gap 58*a* can be widened by dismounting side 70*b*, counter-clockwise turning of gap screw 40, and remounting of side 70*b*. It is easily appreciated, that by the technique described, infinitely fine adjustments of gap 58*a* are convenient, practical, and easily accomplished. Experience with this embodiment clearly indicates that Yo-Yo players of ordinary skill easily arrive at the desired adjustment of the Yo-Yo of FIG. 1 with an adjustment trial or two. The desired adjustment provides both longest possible spin time and reliable return of the Yo-Yo under the player's control of tension in string 10 with ordinary skill and technique. Once the desired adjustment is achieved, experience indicates that readjustment is only occasionally required as the fibers of the typical common Yo-Yo string become compacted, whereupon slight reduction of gap 58*a* is made in the manner described above. Replacement of string 10 typically requires widening of gap 58*a*.

In summary, a player of the Yo-Yo of FIG. 1 begins with string 10 fully wound in narrow gap 58*a* and in wider gap 76 with the outer end of string 10 attached to a finger of one hand. Having earlier finely adjusted and then securely fixed narrow gap 58*a* for advantageous performance of the Yo-Yo as described above, the player casts the Yo-Yo downward causing the string to unwind and the Yo-Yo to spin. As the Yo-Yo reaches the end of string 10, gravity immediately acts to apply continuous tension to string 10. Strand 12 under transmitted and amplified tension from string 10 is caused to elastically reduce its diameter, releasing pressureful contact with inner faces 58 and thus allowing the Yo-Yo to spin freely while hanging at the end of string 10. The player can then apply a sharp vertical tug to string 10 causing a brief increase in tension followed immediately by substantial or total loss of tension in string 10. Strand 12 then reacts elastically to the transmitted loss of tension, expanding its diameter laterally into pressureful clutching contact with inner faces 58, thus positively initiating rewinding of string 10. Continued inertial spinning momentum of the Yo-Yo winds string 10 snugly in wider gap 76 returning the Yo-Yo to the player's hand.

CONCLUSION, RAMIFICATIONS, AND SCOPE

Accordingly, a tethered aerial top or "Yo-Yo" of the present invention provides players of ordinary skill with a Yo-Yo having extraordinary reliability in performance, extended range of playability, and consequent increased pleasure in use. It is seen from this specification that complicating and performance limiting "protuberances" or "raised ribs" at the inner faces of the Yo-Yo sides, torque inducing viscous grease lubricants in the axle bearing, and appendages to the periphery of the axle bearing are avoided; in their place, elastic properties of the tether are advantageously used in direct cooperation with immediately adjacent smooth annular surfaces of the Yo-Yo sides to provide a simple clutch mechanism directly controlled by the player. In addition, infinitely fine adjustment to the width of the gap between the clutch surfaces and attendant seizing of the sides of the Yo-Yo to fix that adjustment assure the player an extended period of best performance with the toy. The present invention has additional advantages in that it:

1. allows the player to adjust the toy to provide best possible performance consistent with many circumstances, including;
   (a) personal style, technique, or other preference,
   (b) type of trick to be performed (sleeping or non-sleeping, etc.),
   (c) ambient playing conditions, such as wind and humidity for example,
   (d) changes in tether caliper due to fiber compaction in normal play, as is known to occur in cotton and mixed fiber tethers currently in common use.
   (e) significant difference in tether caliper known to occur between a tether used to the point of replacement and the replacement tether, or as may occur in changing from a tether of one type to a tether of another type, or in changing from a tether from one supplier to a tether from another.

2. provides greatly extended tether life by presenting deliberately smooth or polished surfaces of rotating parts everywhere those surfaces can intentionally or unintentionally contact the tether, and by providing deliberate contact between a strand of the tether at the axle and rotating parts only when absolutely required to initiate rewinding of the string.

3. provides novice and expert players with a Yo-Yo uniquely adapted for learning the Yo-Yo art and learning new tricks and techniques, where it further:
   (a) is easily adjusted to avoid "sleeping", giving the learner a proper Yo-Yo for learning many beginner tricks where sleeping is not required.
   (b) avoids many of the presently common frustrations of learning, giving the learner longer spin time when sleeping is required and more reliable initiation of rewinding of the string.
   (c) is less likely to wedge or to tangle the string between the sides, given the wider space between the sides beyond the loop wrapped around the axle.
   (d) provides easy release of a string wedged or tangled in the space between the sides.
   (e) avoids the need for and the use of viscous grease lubricants in the axle bearing.

The particular drawings and descriptions provided in this specification should not be construed as limiting the scope of this invention. For example:

1. Each Yo-Yo side can be fabricated of one piece of any suitable material, rather than using a combination of materials; that is, an all metal or all plastic side might be used instead of using wood for the main body of a side with a permanently seated metal plug, as described in the specification.

2. The elastic tether, though commonly available fabricated of cotton or other fibrous materials, might be fabricated of other elastic materials.

3. An earlier but currently less preferred embodiment of the invention provides all the functions of the embodiment described in the specification without dismounting any part of the Yo-Yo to adjust the gap between the sides; in that earlier embodiment seizing of the Yo-Yo sides to fix the gap width is accomplished from the outer face of one Yo-Yo side.

4. A Yo-Yo of the present invention can be styled in many shapes, sizes, and appearances since, as has been shown, all axle parts of the preferred embodiment excepting the tether itself are internal and substantially hidden from view.

5. The present invention, though advantageously provided with a ball bearing at the axle, can easily be adapted for use with a roller or "needle" bearing, or a simple sleeve bearing; less advantageously, it might be used with a fixed axle of least possible diameter, reintroducing some capstan friction.

6. A narrow space or gap in the proximity of the axle bearing and a wider gap beyond that proximity are described in the specification with their correlating advantages. It is known, through successful fabrication of another specific embodiment of the present invention, that these gaps can be of the same rather than different widths; in this embodiment some loss of playability is experienced in certain types of Yo-Yo play, with some gains in other types of play.

Thus the scope of the present invention should be determined by the appended claims and their legal equivalents rather than by the particular drawings and descriptions given.

We claim:

1. A tethered aerial top comprising in combination;
shaft means,
bearing means centrally mounted on said shaft means,
elastic tether means with a portion thereof attached to said bearing means,
rotatable inertia means comprising in combination two disc-like sides, each adjustably connected to said shaft means at a lateral extremity thereby defining inner faces and with space between said inner faces of each of said sides,
and cooperating, means disposed with said shaft means, said bearing means, and said sides, said cooperating means further comprising
threaded adjustment means allowing infinitely fine variation of said space between said sides to result in selective engagement of said portion of said elastic tether means, and seizing means connecting said shaft to said sides causing each said threaded adjustment means to engage said bearing means and one of said sides providing secure fixation of said shaft means and said cooperating means between said sides.

2. The tethered aerial top of claim 1;

wherein tension applied to said tether means acts elastically within said tether means to hold said portion substantially free of pressureful contact with said cooperating means and said sides, and wherein tension substantially reduced or removed from said tether means acts elastically within said tether means to engage said portion in pressureful laterally directed clutching contact with said cooperating means thence said sides.

3. The tethered aerial top of claim 1;

wherein said space further comprises in combination, a laterally narrow space in radial proximity to said bearing means wherein said portion of said tether means is attached to said bearing means, and a laterally wider space radially beyond said narrow space wherein said tether means can be wound.

4. The tethered aerial top of claim 1;

wherein said inner faces of each of said sides, laterally bounding said space, are smooth and continuous annular surfaces.

5. The tethered aerial top of claim 3;

wherein surfaces of said cooperating means laterally bounding said narrow space are smooth and continuous annular surfaces, and wherein surfaces of said sides laterally bounding said wider space are smooth and continuous annular surfaces.

6. A tethered aerial top comprising in combination;

rotatable inertia means further comprising in combination two disc-like sides, each adjustably connected to common shaft means at the lateral extremities thereof and with space between said sides, bearing means centrally mounted on said shaft means between said sides, tether means having elastic properties, with a portion of said tether means attached to said bearing means, and improvements comprising in combination, cooperating means disposed with at least one of said sides, with said bearing means, and with said shaft means, said cooperating means further comprising;

threaded adjustment means allowing infinitely fine variation of said space between said sides to result in selective engagement of said portion of said elastic tether means.

and seizing means connecting said shaft to said sides causing each said threaded adjustment means to engage said bearing means and one of said sides providing secure fixation of said shaft means and said cooperating means between said sides.

7. The tethered aerial top of claim 6;

wherein said tether means, said bearing means, said shaft means, said inertia means, said adjustment means, and said seizing means comprise in combination an efficient, adjustable, and controllable clutch;

wherein tension applied to said tether means, in normal play with said top, holds said portion substantially free of pressureful contact with said sides, and wherein tension substantially removed from said tether means, in normal play with said top, engages said portion in pressureful lateral contact with said sides.

8. The tethered aerial top of claim 6;

wherein said space further comprises in combination, a laterally narrow space in radial proximity to said bearing means wherein said portion of said tether means is attached to said bearing means, and a laterally wider space radially beyond said narrow space wherein said tether means can be wound.

9. The tethered aerial top of claim 6;

wherein said inner faces of each of said sides, laterally bounding said space, are smooth and continuous annular surfaces.

10. The tethered aerial top of claim 8;

wherein surfaces of said cooperating means laterally bounding said narrow space are smooth and continuous annular surfaces, and wherein surfaces of said sides laterally bounding said wider space are smooth and continuous annular surfaces.

* * * * *